US010650994B2

(12) United States Patent
Bauer et al.

(10) Patent No.: US 10,650,994 B2
(45) Date of Patent: May 12, 2020

(54) SWITCHING DEVICE ARRANGEMENT

(71) Applicant: SIEMENS AKTIENGESELLSCHAFT, Munich (DE)

(72) Inventors: Sascha Bauer, Berlin (DE); Frank Ehrlich, Hohen Neuendorf (DE); Andreas Groiss, Falkensee (DE); Rico Rademacher, Ludwigsfelde (DE); Ingolf Reiher, Berlin (DE); Peter Schmidt, Berlin (DE)

(73) Assignee: Siemens Aktiengesellschaft, München (DE)

( * ) Notice: Subject to any disclaimer, the term of this patent is extended or adjusted under 35 U.S.C. 154(b) by 15 days.

(21) Appl. No.: 16/316,061

(22) PCT Filed: Jun. 26, 2017

(86) PCT No.: PCT/EP2017/065628
§ 371 (c)(1),
(2) Date: Jan. 8, 2019

(87) PCT Pub. No.: WO2018/015104
PCT Pub. Date: Jan. 25, 2018

(65) Prior Publication Data

US 2019/0237281 A1 Aug. 1, 2019

(30) Foreign Application Priority Data

Jul. 19, 2016 (DE) ..... 10 2016 213 158

(51) Int. Cl.
*H01H 33/02* (2006.01)
*H01H 33/42* (2006.01)
(Continued)

(52) U.S. Cl.
CPC ..... *H01H 33/66207* (2013.01); *H01H 33/42* (2013.01); *H01H 33/56* (2013.01);
(Continued)

(58) Field of Classification Search
CPC ..... H01H 33/66207; H01H 33/666; H01H 33/42; H01H 33/28; H01H 33/53;
(Continued)

(56) References Cited

U.S. PATENT DOCUMENTS 3,335,245 A 8/1967 McCloud
4,442,329 A 4/1984 Gray et al.
(Continued)

FOREIGN PATENT DOCUMENTS

DE 695051 C 5/1940
DE 3608548 C2 5/1994
(Continued)

OTHER PUBLICATIONS

Translation of EP2023361 (original doc. published Feb. 11, 2011) (Year: 2011).*
(Continued)

*Primary Examiner* — William A Bolton
(74) *Attorney, Agent, or Firm* — Laurence Greenberg; Werner Stemer; Ralph Locher

(57) ABSTRACT

A switching device arrangement has an encapsulation housing and also a drive device. The drive device is supported on the encapsulation housing. The drive device is arranged at a distance from the encapsulation housing via a spacer device. A receiving space is delimited by the spacer device.

22 Claims, 2 Drawing Sheets

(51) Int. Cl.
*H01H 33/56* (2006.01)
*H01H 33/662* (2006.01)
*H01H 33/666* (2006.01)

(52) U.S. Cl.
CPC ..... *H01H 33/666* (2013.01); *H01H 33/022* (2013.01); *H01H 2033/024* (2013.01); *H01H 2033/6623* (2013.01)

(58) Field of Classification Search
CPC ..... H01H 33/56; H01H 33/02; H02B 13/035; H02B 5/06
USPC ..... 218/138, 139, 155, 156
See application file for complete search history.

(56) References Cited

U.S. PATENT DOCUMENTS

| | | | | |
|---|---|---|---|---|
| 4,471,187 | A | 9/1984 | Sturzenegger et al. | |
| 4,769,740 | A | 9/1988 | Wagenbach et al. | |
| 5,932,858 | A * | 8/1999 | Meinherz ..... | H01H 33/53 218/154 |
| 6,407,908 | B1 * | 6/2002 | Iryo ..... | H01H 33/42 200/82 B |
| 8,481,881 | B2 | 7/2013 | Saxl et al. | |
| 9,666,392 | B2 | 5/2017 | Gruenler et al. | |
| 2008/0197008 | A1 * | 8/2008 | Einschenk ..... | H01H 33/6661 200/48 R |
| 2009/0120909 | A1 | 5/2009 | Gimeno et al. | |
| 2013/0098875 | A1 | 4/2013 | Ohda et al. | |
| 2013/0213937 | A1 | 8/2013 | Yoshida et al. | |
| 2015/0027985 | A1 | 1/2015 | Yanagi et al. | |
| 2015/0136739 | A1 | 5/2015 | Hashimoto et al. | |

FOREIGN PATENT DOCUMENTS

| | | | |
|---|---|---|---|
| DE | 102013210136 | A1 | 12/2014 |
| EP | 2023361 | A1 | 2/2009 |
| EP | 2273525 | A1 | 1/2011 |
| JP | 5183831 | B2 | 4/2013 |
| KR | 101246696 | B1 | 4/2013 |

OTHER PUBLICATIONS

ABB Product Brochure: "Gas-Insulated Switchgear ELK-04 Modular System up to 170 kV, 4000 A, 63 kA", Sep. 2009.

* cited by examiner

SWITCHING DEVICE ARRANGEMENT

BACKGROUND OF THE INVENTION

Field of the Invention

The invention relates to a switchgear assembly having a metal-clad housing and a drive device which is connected to a kinematic chain for transmitting a movement which can delivered by the drive device into the inside of the metal-clad housing and is mounted at least partially on the metal-clad housing.

A switchgear assembly with a metal-clad housing is known, for example, from the publication DE 10 2013 2010 136 A1. The switchgear assembly therein has two drive devices which are mounted on the metal-clad housing. A movement is transmitted, starting from the drive devices, via kinematic chains into the inside of the metal-clad housing. The two drive devices are oriented in opposite directions such that a large number of identical parts can be used. A structure results thereby which requires a relatively large amount of space. The guidance of the kinematic chains of the two drive devices is in particular complex, direct access to the kinematic chains being possible from outside the metal-clad housing. The complex guidance of the kinematic chain and the ability to access the kinematic chain restrict the reliability of the known switchgear assembly.

SUMMARY OF THE INVENTION

The object of the invention is therefore to provide a switchgear assembly which has a reliable and compact construction.

The object in the case of a switchgear assembly of the type mentioned at the beginning is achieved according to the invention by the drive device being mounted on the metal-clad housing via a spacer device which creates a receiving space between the drive device and the metal-clad housing.

A switchgear assembly is an assembly which serves to switch an electric current. For this purpose, the switchgear assembly has, for example, a phase conductor, the impedance of which can be modified. A phase conductor can have, for example, switch contact pieces which can move relative to one another and can be moved relative to one another, for example, by means of a drive device. In order to connect through the phase conductor (low impedance), the switch contact pieces can be brought into galvanic contact. In order to disconnect the phase conductor (high impedance), the switch contact pieces can be moved apart from each other. A switchgear assembly can be used, for example, as a power switch, a disconnect switch, a load switch, a grounding switch, etc. By means of a metal-clad housing, the phase conductor, which can have a modifiable impedance, can be arranged so that it is surrounded at least in places by the metal-clad housing. It can, for example, be provided that the metal-clad housing forms a barrier around the phase conductor, for example around a section of the phase conductor, which can have a modifiable impedance such that the inside of the metal-clad housing is in particular separated hermetically from the outside of the metal-clad housing. A drive device can here be situated outside the metal-clad housing such that the volume inside the metal-clad housing (the volume surrounded by the metal-clad housing) does not to be increased by the size of the drive device. Instead, a movement which can be generated by the drive device is transmitted by means of a kinematic chain through the metal-clad housing into the inside of the metal-clad housing.

The dimensions of the metal-clad housing can accordingly be reduced, in particular in the case of a metal-clad housing designed as a fluid-tight barrier. When the metal-clad housing is designed as a pressure vessel, a metal-clad housing having a sufficient mechanical resistance with respect to a difference in pressure can in particular be formed. The kinematic chain can advantageously traverse the metal-clad housing in fluid-tight fashion such that the barrier effect of the metal-clad housing is not affected even when a relative movement is transmitted through the metal-clad housing.

Storage drives, for example hydraulic drives, spring-storage drives, electrodynamic drives, etc can be used, for example, as the drive device. Storage drives have the advantage that energy which is needed to generate a drive movement can be stored temporarily in a store and can be converted into a movement when required. Autonomous operation of the drive device, and hence reliable operation of the switchgear assembly, is thus possible in particular for safety reasons. The drive device is here a system to which, on the one hand, energy in a first form is supplied and from which, on the other hand, energy in the form of a movement (different from the first form) is delivered. For example, electrical energy can be converted into mechanical energy in the drive device and as such stored temporarily as, for example, elastic potential energy so that it can subsequently be delivered in the form of a movement. After (in particular temporarily stored) energy has been converted inside the drive device into a movement, the movement can be transmitted, transferred, distributed, etc via the kinematic chain. A kinematic chain can here have different components such as shafts, connecting rods, bars, gearwheels, etc. The kinematic chain can have a gear which serves, for example, to direct, conduct, and possibly convert a movement.

The metal-clad housing and the drive device assume a defined position relative to each other by the drive device being supported on the metal-clad housing. Thus, on the one hand, the switchgear assembly can be mounted quickly and, on the other hand, the positions of the drive device and the metal-clad housing, and hence also phase conductors arranged in the inside of the metal-clad housing, remain virtually unchanged. The drive device can be connected to the metal-clad housing by means of the use of a spacer device. A spacer device creates, between the metal-clad housing and the drive device, a receiving space which extends between the metal-clad housing and the drive device. The receiving space is preferably traversed by a tensioning device which extends between the metal-clad housing and the drive device. The spacer device can transmit tensile forces between the metal-clad housing and the drive device. The spacer device can here at least partially delimit the receiving space, for example the spacer device can be designed, for example, in the manner of a stud bolt or a plurality of stud bolts such that, on the one hand, mechanical fixing of the metal-clad housing and the drive device relative to each other is ensured and, on the other hand, a gap is created between the drive device and the metal-clad housing in the form of the receiving space. Further components can be arranged inside the receiving space. By means of the spacer device, it is furthermore made possible in a simplified fashion to connect drive devices of different designs to one and the same metal-clad housing so that a sufficient volume is created, for example, inside the receiving space in order to accommodate parts, for example also auxiliary devices of a drive device, and that drive devices of different types can thus be associated variably with a metal-clad housing, with the design of the switchgear assembly being uniformly compact. The drive device can advantageously span part of the receiving space or partially delimit the receiving space.

The receiving space is advantageously separated from the inside of the metal-clad housing.

A further advantageous embodiment can provide that a part of the kinematic chain is arranged in the receiving space.

The kinematic chain can advantageously extend at least partially inside the receiving space. The kinematic chain can, for example, traverse the receiving space. As a result, a section is created, between the drive device and the metal-clad housing, which is mechanically protected by the metal-clad housing itself and the drive device. In addition, the spacer device can protect the kinematic chain. The spacer device can, for example, encase the receiving space in the manner of a cage and thus protect it from access transversely.

A further advantageous embodiment can provide that in the kinematic chain, a movement which needs to be transmitted is converted in the receiving space from a rotational movement into a translational movement, or vice versa.

A region is provided inside the receiving space in which, for example, even more complex (for example, large-scale) gear elements of a kinematic chain can be accommodated.

Thus, a rotational movement can be converted into a translational movement, or a translational movement into a rotational movement, for example by means of a slider crank mechanism. The components of the kinematic chain which are required for this purpose can extend at least partially inside the receiving space between the metal-clad housing and the drive device. The metal-clad housing can here be spanned at least partially by the drive device so that the receiving space is at least partially covered by the spacer device, in particular enclosed axially by the drive device. In order to convert a movement in the kinematic chain, the spacer device can, for example, also be used in order to provide, for example, bearing points for shafts. As a result, the spacer device can, for example, also serve as a bearing for the kinematic chain.

It can advantageously furthermore be provided that the kinematic chain is divided in the receiving space into multiple branches, or vice versa.

Dividing the kinematic chain into multiple branches has the advantage that, for example, a movement which is delivered by the drive device and is coupled into the kinematic chain can be divided into multiple branches of the kinematic chain so that this movement can serve, for example, also to activate a plurality of switch contact pieces, for example in a plurality of phase conductors which are situated inside the metal-clad housing. It is thus, for example, possible to dimension the elements provided for transmission into the individual branches so that they are smaller owing to the reduced forces. It can also be provided that a reversed principle is employed and multiple branches are combined in the receiving space.

A further advantageous embodiment can provide that the kinematic chain has a yoke body.

By means of a yoke body, it is possible to initiate a movement in the yoke body and transmit this movement from the yoke body into multiple branches (or vice versa). A yoke body can, for example, execute essentially a translational movement, wherein branching of the movement of the kinematic chain should be effected preferably axially parallel to the movement of the yoke body.

Dividing a movement into multiple branches, or the opposite thereof, can advantageously take place by the flow of force in the kinematic chain being branched at least partially inside the receiving space.

A further advantageous embodiment can provide that the spacer device is arranged on a bulging wall of the metal-clad housing.

A bulging wall of the metal-clad housing can be stamped so that it is concave or convex, for example in the direction of the spacer device. The bulging wall can be stabilized by the spacer device being set on the bulging wall, said wall being, for example, reinforced. In particular when pressure is applied, for example in the case of an embodiment of the metal-clad housing as a pressure vessel, the metal-clad housing can be mechanically reinforced by means of the spacer device. The spacer device can, for example, form ribbing on the bulging wall. The spacer device can thus stabilize the bulging wall, in particular in the border area of the bulging wall. The spacer device can, for example, also enclose the bulging wall. The spacer device can be connected to the metal-clad housing by being bonded.

The bulging wall can have an opening which serves for the kinematic chain to pass (preferably in sealed fashion) into the inside of the metal-clad housing.

A further advantageous embodiment can provide that a flange surface is arranged in the bulging wall.

The bulging wall itself can be delimited by a flange. It can, however, also be provided that a flange surface is arranged in the bulging wall such that an attachment point, on which it is possible to stabilize or support further modules, is formed in the bulging wall. The flange surface can, for example, be a circular flange surface which for its part surrounds an opening in the metal-clad housing, in particular inside the bulging wall. The flange surface can here have an essentially flat design.

The flange surface can here lie on a protruding shoulder inside the bulging wall. It can, however, also be provided that the flange surface is arranged in a blind depression in the bulging wall. In particular in the case of a blind depression of the flange surface in the bulging wall, the direction in which the wall bulges and the direction in which the depression deepens can be oriented in opposite directions. As a result, further reinforcement of the bulging wall is additionally obtained.

It can furthermore advantageously be provided that multiple flange surfaces are arranged in the bulging wall which are oriented relative to each other so that they are essentially parallel, in particular lying essentially within a plane.

Multiple flange surfaces can be arranged in the bulging wall. The flange surfaces here preferably have similar dimensions. In particular, the flange surfaces can each have an essentially planar design, wherein multiple flange surfaces are arranged parallel to one another. In particular, the flange surfaces can be oriented so that they lie essentially within a plane relative to one another. The flange surfaces are here preferably oriented approximately parallel to one another, in the same fashion as the flange surfaces can be oriented approximately parallel to one another. The flange surfaces can here lie within the maximum extent of the bulge. In other words, the flange surfaces preferably lie within the footprint of the bulge of the bulging wall.

A further advantageous embodiment can provide that the spacer device is arranged on a cover of the metal-clad housing.

If the spacer device is arranged on a cover of the metal-clad housing, the dimensions of the spacer device can be modified simply by the choice of the cover, or by replacing the latter. In particular in the case of a pressure vessel, the cover can be mechanically stabilized by the spacer device.

The cover can be surrounded, for example, at its periphery by a flange, wherein a bulging wall can be elevated on the cover of the metal-clad housing, from the flange at the outer periphery. The spacer device can here advantageously be placed in the edge region of the cover such that the metal-clad housing can be closed by means of the cover, and the spacer device is arranged on that face of the cover which faces away from the inside of the metal-clad housing. The spacer device can advantageously be connected by bonding, in particular integrally, to the metal-clad housing or to the cover of the metal-clad housing.

It can furthermore advantageously be provided that, enclosed by the spacer device, a movement can be introduced in a fluid-tight fashion into the inside of the metal-clad housing.

The spacer device can extend around the receiving space such that the spacer device encloses in particular the lateral surface of the receiving space. "Encloses the lateral surface" here refers to an axis which extends between the metal-clad housing and the drive device which is separated from it by the spacer device. Because a kinematic chain is encased by means of the spacer device, the kinematic chain is protected from radially acting forces by means of the spacer device. This makes it possible, on the one hand, to reposition the kinematic chain outside the metal-clad housing and also to protect it mechanically, and thus for the kinematic chain not to be entirely associated with the inside of the metal-clad housing. Furthermore, a fluid-tight transition of the kinematic chain into the inside of the metal-clad housing is protected by the spacer device. The receiving space between the metal-clad housing and the drive device can thus be used flexibly in order to accommodate different forms of the kinematic chain and to introduce the kinematic chain, protected by the spacer device, into the inside of the metal-clad housing. It can advantageously be provided that the kinematic chain completely traverses the receiving space, wherein the direction in which the kinematic chain traverses it essentially follows an axis which extends between the metal-clad housing and the drive device which is held at a distance from the metal-clad housing by the spacer device.

It can furthermore advantageously be provided that the spacer device is annular.

The spacer device can advantageously be annular such that a spacer device which is stabilized both dielectrically and mechanically is formed. The annular shape does not need to be formed completely here. The spacer device can, for example, delimit an enveloping contour of the (in particular annular) receiving space. For this purpose, multiple stud bolts can, for example, delimit a shell contour of the spacer device. Depending on the arrangement of the stud bolts, differently positioned spacer devices can be formed. An annular shape can, however, be formed, for example, in the form of a hollow cylinder which has, for example, a circular cross-section. The spacer device can, for example, have an annular shape and be formed only in segments or have perforations in a wall. The spacer device can, for example, be set on the metal-clad housing and surround a bulging wall. In particular when the wall bulges in the manner of a spherical cap, the spacer device can extend, corresponding simply to the diameter of the spherical cap, circularly around the bulging wall. The annular shape can here also be perforated by recesses such that a reinforced spacer device can be formed by measures that use less material and hence have less mass. The spacer device can, for example, be formed annularly such that the spacer device is surrounded on the metal-clad housing by an annular flange so that, for example, a cover of the metal-clad housing is delimited. In addition to a circular design of the ring, other, for example ellipsoid, polygonal, polygonally interrupted manifestations of an annular shape can also be provided.

A further advantageous embodiment can provide that the drive device and the spacer device are connected to each other via an adapter assembly.

The use of an adapter assembly between the drive device and the spacer device makes it possible to adapt the spacer device and the drive device to each other without there being any need to engage structurally in the drive device or the spacer device. The adapter assembly can, for example, be a plate which is designed so that it at least partially spans the receiving space. The adapter assembly can thus at least partially close off the receiving space above the metal-clad housing. The kinematic chain can pass through the adapter assembly and connect the drive device to the metal-clad housing via the spacer device.

A further advantageous embodiment can provide that the inside of the metal-clad housing is filled with an electrically insulating fluid.

The metal-clad housing encloses a volume inside which, for example, a phase conductor of the switchgear assembly is accommodated. The metal-clad housing can as such be filled with an electrically insulating fluid which serves to electrically insulate a phase conductor arranged inside the metal-clad housing. The electrically insulating fluid can have excess or reduced pressure applied to it such that the metal-clad housing represents a pressure vessel which hermetically encloses the electrically insulating fluid. Gases or liquids containing fluorine, such as sulfur hexafluoride, fluoroketone, fluoronitrile, or carbon dioxide, oxygen, nitrogen, purified air, and mixtures of these media, can be used, for example, as electrically insulating fluids.

A further advantageous embodiment can provide that a phase conductor, in particular a circuit breaker unit, is supported in an electrically insulating fashion on the flange surface.

It is possible to support a phase conductor, so that it is positioned at a distance from the metal-clad housing, on a flange surface which is arranged in a bulging wall of the metal-clad housing. The separation of the phase conductor from the metal-clad housing in an electrically insulating fashion makes it possible to manufacture the metal-clad housing from an electrically conductive material, wherein the distance extending between the phase conductor and the metal-clad housing is electrically insulated, for example by means of an electrically insulating fluid which is arranged inside the metal-clad housing. A flange surface can surround an opening through which the kinematic chain passes into the inside of the metal-clad housing.

The phase conductor can in particular be part of a circuit breaker unit of the switchgear assembly such that switching, i.e. disconnecting or switching through a phase conductor can also take place inside the metal-clad housing. By virtue of the flange surface, it is possible to position the phase conductor, in particular a circuit breaker unit in the phase conductor, inside the metal-clad housing and thus, for example, also to accommodate a plurality of phase conductors which need to be kept apart from one another in an electrically insulating fashion. It is thus possible to design the metal-clad housing or the switchgear assembly in so-called multi-phase insulation, wherein an electrically insulating fluid arranged inside the metal-clad housing electrically insulates a plurality of phase conductors of different electrical potentials from each other.

BRIEF DESCRIPTION OF THE SEVERAL VIEWS OF THE DRAWING

An exemplary embodiment of the invention is described below and subsequently shown schematically in drawings. There is shown.

DESCRIPTION OF THE INVENTION

Figure 1:
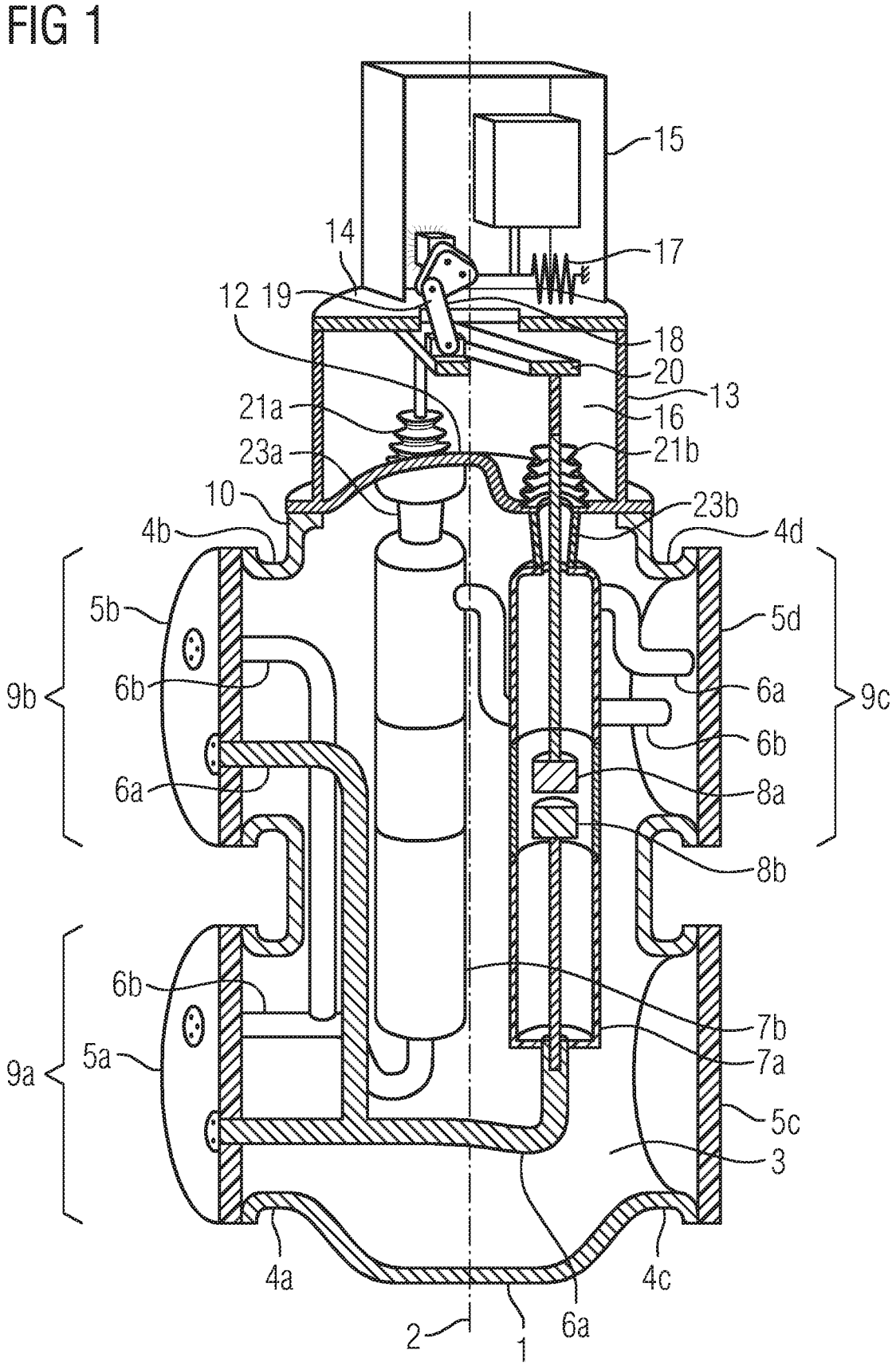
FIG. 1 a section through a switchgear assembly shown in perspective.

The switchgear assembly according to FIG. 1 has a metal-clad housing 1. The metal-clad housing 1 has an essentially hollow cylindrical design and extends with its hollow cylindrical axis along a main axis 2. The metal-clad housing 1 accordingly has an essentially circular cross-section coaxially with the main axis 2. In the present case, the metal-clad housing 1 is designed as a pressure vessel such that the inside 3 of the metal-clad housing 1 can be filled with an electrically insulating fluid which is at an elevated pressure and is prevented from evaporating by the metal-clad housing 1. The metal-clad housing 1 has respective diametrically opposite connection flanges 4*a*, 4*b*, 4*c*, 4*d* on its lateral surface. The connection flanges 4*a*, 4*b*, 4*c*, 4*d* are sealed in fluid-tight fashion by flange covers 5*a*, 5*b*, 5*c*, 5*d*. When required, the flange covers can act as dummy covers, i.e. the flange covers 5*c* close the associated connection flange 4*c* in fluid-tight fashion. Alternatively, the flange covers 5*a*, 5*b*, 5*d* can also serve as bushes such that phase conductors 6*a*, 6*b* can pass through the flange covers 5*a*, 5*b*, 5*d* so that they are held in a fluid-tight and electrically insulating fashion, wherein the flanges 4*a*, 4*b*, 4*d* are closed in fluid-tight fashion. The electrically insulating fluid flows around phase conductors 6*a*, 6*b* inside the metal-clad housing 1. The phase conductors 6*a*, 6*b* are in each case partially designed as a circuit breaker unit 7*a*, 7*b*. The circuit breaker units 7*a*, 7*b* have contact pieces 8*a*, 8*b* which can move relative to one another. It is thus possible to disconnect or switch through the phase conductors 6*a*, 6*b* by means of the associated circuit breaker units 7*a*, 7*b*. Vacuum tubes inside the metal-clad housing 1 can serve as circuit breaker units 7*a*, 7*b*. The circuit breaker units 7*a*, 7*b* are part of the phase conductors 6*a*, 6*b*. When required, the phase conductors 6*a*, 6*b* can be divided into a first part branch 9*a* and a second part branch 9*b*. It can thus be provided that a first part branch 9*a* leads out of the metal-clad housing 1 via a connection flange 4*a* and flange cover 5*a*. It can furthermore be provided that a second part branch 9*b* leads out of the metal-clad housing 1 via a connection flange 4*d* and flange cover 5*d*. The two part branches 9*a*, 9*b* are here connected to the same side of the circuit breaker unit 7*a*, 7*b*. In contrast, the other side of the circuit breaker unit 7*a*, 7*b* is in contact with a third part branch 9*c* which leads to the outside of the metal-clad housing 1 from inside the metal-clad housing 1 via a connection flange 4*c* and a flange cover 5*c*. It is thus possible to electrically separate, when required, the third part branch 9*c* of the phase conductors 6*a*, 6*b*, with the interposition of the circuit breaker units 7*a*, 7*b*, from the first and the second part branch 9*a*, 9*b*, or to effect an electrical contact.

An end flange 10 is arranged at the end of the metal-clad housing 1. The end flange 10 has a circular contour which is spanned and closed by a metal-clad housing cover 11. The metal-clad housing cover 11 of the metal-clad housing 1 is connected to the end flange 10 in fluid-tight fashion and has a bulging wall 12. The bulging wall 12 is part of a spherical cap which is delimited by an annular circumferential flange (corresponding to the end flange 10), situated on the outside, of the metal-clad housing cover 11. A spacer device 12 is connected to the metal-clad housing cover 11 by being bonded to it. In the present case, the spacer device 13 and the metal-clad housing cover 11 are formed from a metal and manufactured in a single piece using a casting process. In the present case, the spacer device 13 has a hollow cylindrical design, wherein the cross-section of the hollow cylinder has a circular design and has dimensions selected such that, on the one hand, the bulging wall 12 is enclosed by the spacer device 13 and, on the other hand, the annular circumferential flange of the metal-clad housing cover 11 projects radially above the spacer device 13. An adapter assembly 14 is provided on that end of the spacer device 13 which is remote from the bulging wall 12. The adapter assembly 14 has an essentially disk-shaped design such that an adapter assembly 15 can be connected to the spacer device 13. The adapter assembly 14 here closes a receiving space 16, enclosed by the spacer device 14, in the direction of the main axis 2 of the metal-clad housing 1 such that the spacer device 13 delimits the receiving space 16 radially, and the bulging wall 12 of the metal-clad housing 1, or the adapter assembly 14, delimits the receiving space 16 axially. The drive device 15 partially spans the receiving space 16. The receiving space 16 is separated from the inside of the metal-clad housing 1 such that neither the adapter assembly 14 nor the spacer device 13 are fluid-tight barriers of a pressure vessel. The drive device 15 is connected to the adapter assembly 14, wherein the drive device 15 is shown, by way of example, as a spring-storage drive. A kinematic chain 18 can be set in motion by means of a storage spring 17. The kinematic chain 18 here passes through the adapter assembly 14, projects into the receiving space 16 and from there leads through a wall of the metal-clad housing 1 into the inside of the metal-clad housing 1. The kinematic chain 18 is connected as such in each case to at least one of the contact pieces 8*a*, 8*b* which can move relative to each other such that switching the circuit breaker units 7*a*, 7*b* is made possible, triggered by the drive device 15 with the interposition of the kinematic chain 18. The kinematic chain 18 has a connecting rod 19 which passes through the adapter assembly 14. For this purpose, the adapter assembly 14 has a cutout through which the connecting rod 19 projects movably. The connecting rod 19 is connected to a yoke body 20 which can move in translation in the receiving space 16. The direction of movement of the yoke body 20 is here oriented essentially in the direction of the main axis 2 of the metal-clad housing 1. Contact pieces 8*a*, 8*b* which can move relative to each other are connected respectively to the yoke body 20. The yoke body 20 is connected to the movable contact pieces 8*a*, 8*b* preferably via electrically insulating drive rods. The yoke body 20 can, for example, have an electrically insulating design or alternatively a drive rod, which connects the yoke body 20 to the contact pieces 8*a*, 8*b* which can move relative to each other, can electrically insulate the yoke body 20 from the electrical potential of the phase conductors 6*a*, 6*b*.

In order to transmit a movement in fluid-tight fashion through a wall of a metal-clad housing 1, it is here provided that flexibly deformable bellows 21*a*, 21*b* are introduced into a wall of the metal-clad housing 1. It is thus possible, with the reversible deformation of the bellows 21*a*, 21*b*, to transmit a linear movement through a wall of the metal-clad housing 1 in sealed fashion. The bellows 21*a*, 21*b* are in each case mounted on flange surfaces 22*a*, 22*b*, 22*c*, wherein the flange surfaces 22*a*, 22*b*, 22*c* each have a circular form and are situated in the bulging wall 12. The flange surfaces 22*a*, 22*b*, 22*c* preferably lie within a plane. For this purpose, in the present case blind depressions, stamped in an opposite direction. The flange surfaces 22*a*, 22*b*, 22*c* thus make it possible for the bellows 21*a*, 21*b* to bear in fluid-tight fashion against the metal-clad housing 1. The bellows 21*a*, 21*b* furthermore bear in fluid-tight fashion against the drive rods, which pass through the wall of the metal-clad housing 1, of the kinematic chain 18. In addition to positioning the bellows 21*a*, 21*b*, the flange surfaces 21*a*, 21*b*, 21*c* have mirror-symmetrically designed flange surfaces 22'*a*, 22'*b*, 22'*c* on which a hollow insulator 23*a*, 23*b* is mounted in each case. The hollow insulators 23*a*, 23*b* are oriented so that they are flush with the flange surface 22*a*, 22*b*, 22*c*, 22'*a*, 22'*b*, 22'*c* such that the hollow insulators 23*a*, 23*b* are each traversed by a (preferably electrically insulating) drive rod of the kinematic chain 18, wherein the hollow insulators 23*a*, 23*b* position the circuit breaker units 7*a*, 7*b* and hence the phase conductors 6*a*, 6*b* inside the metal-clad housing 1.

Figure 2:
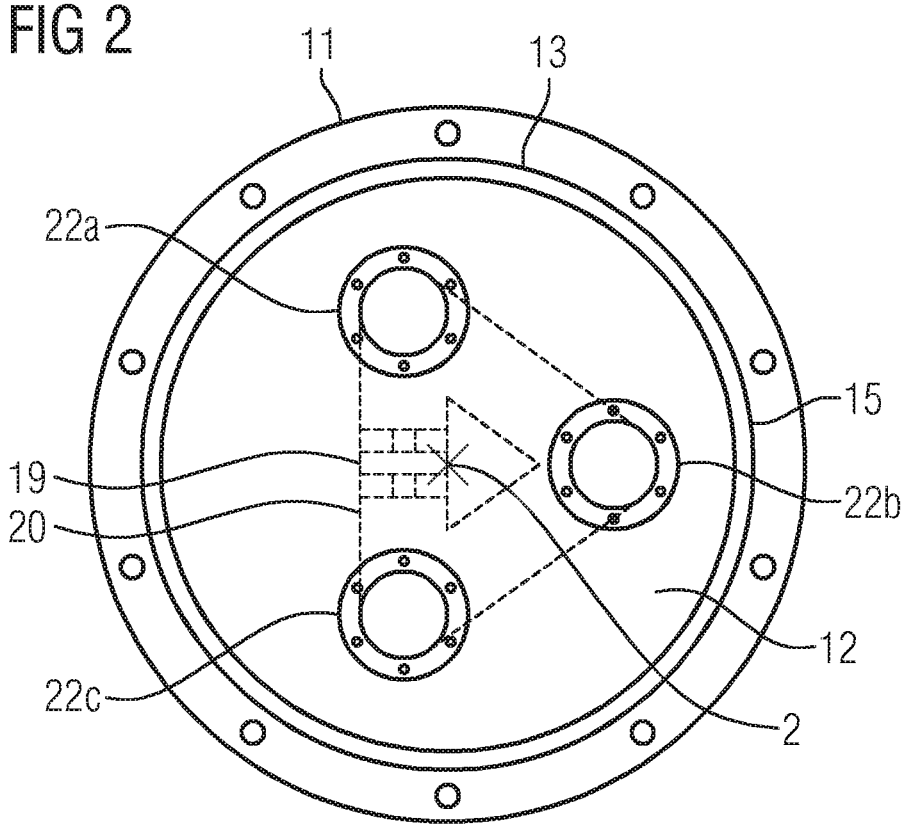
FIG. 2 a plan view of a spacer device.

FIG. 2 shows a plan view of the metal-clad housing cover 11 with the spacer device 13. The spacer device 13 has a circular cross-section and surrounds a bulging wall 12 in the metal-clad housing cover 11. The flange surfaces 22*a*, 22*b*, 22*c* on which the bellows 21*a*, 21*b* are placed can be seen in the bulging wall 12. It can be seen here that three phase conductors 6*a*, 6*b*, together with three circuit breaker units 7*a*, 7*b*, can be arranged inside the metal-clad housing in a fashion such that they are electrically insulated from one another. Owing to the plane of section, only two phase conductors 6*a*, 6*b* can be seen in FIG. 1, wherein a circuit breaker unit 7*a* is illustrated in the section. In FIG. 2, a continuous dashed line indicates the position of the yoke body 20 which is arranged so that it is situated above the flange surfaces 22*a*, 22*b*, 22*c* as part of the kinematic chain 18 and can be displaced via the connecting rod 19 in the direction of the main axis 2. The mirror-symmetrical flange surfaces 22*a*, 22*b*, 22*c*, on which hollow insulators 23*a*, 23*b* are mounted, extend flush with the visible flange surfaces 22*a*, 22*b*, 22*c*, on that side of the plane of the drawing which is averted from FIG. 2.

Figure 3:
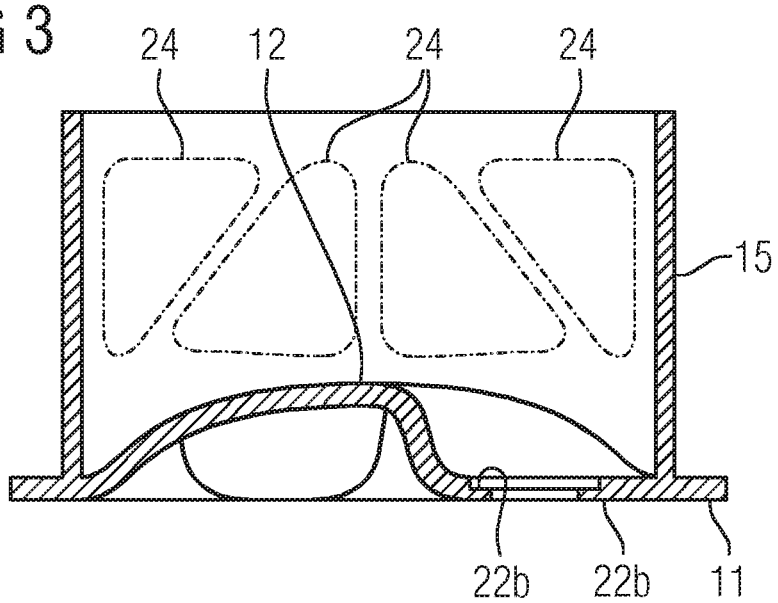
FIG. 3 a section through the spacer device from FIGS. 1 and 2.

The metal-clad housing cover 11 known from FIGS. 1 and 2 is illustrated in the cross-section shown in FIG. 3. The blind depression of the flange surfaces 22*a*, 22*b*, 22*c* in the bulging wall 12 can be seen with the aid of this cross-section. The blind depression is here stamped to a depth such that the flange plane of the flange surrounding the metal-clad housing cover 11 is not traversed. Simplified fitting and improved handling of the metal-clad housing cover 11, together with the spacer device 13, is thus ensured. The possibility of arranging recesses in the wall of the spacer device is indicated by continuous dashed lines.

The invention claimed is:

1. A switchgear assembly, comprising:

an encapsulating housing;

a drive device and a kinematic chain connected to said drive device for transmitting a movement of said drive device into an interior of said encapsulating housing; and a spacer device mounting said drive device to said encapsulating housing, said spacer device forming a receiving space between said drive device and said encapsulating housing;

said encapsulating housing including a bulging wall formed with a flange surface, and said spacer device being mounted on and enclosing said bulging wall.

2. The switchgear assembly according to claim 1, wherein a portion of said kinematic chain is arranged in said receiving space.

3. The switchgear assembly according to claim 1, wherein said kinematic chain is configured in said receiving space to convert a movement to be transmitted from a rotational movement into a translational movement, or vice versa.

4. The switchgear assembly according to claim 1, wherein said kinematic chain is divided in said receiving space into a plurality of branches, or vice versa.

5. . The switchgear assembly according to claim 1, wherein said kinematic chain includes a yoke body.

6. The switchgear assembly according to claim 1, wherein said encapsulating housing is formed with a cover and said spacer device is arranged on said cover.

7. The switchgear assembly according to claim 1, wherein said spacer device is disposed so that the movement is introduced in a fluid-tight manner into the interior of said encapsulating housing.

8. The switchgear assembly according to claim 1, wherein said spacer device is annular.

9. The switchgear assembly according to claim 1, which comprises an adapter assembly connecting said drive device and said spacer device to one another.

10. The switchgear assembly according to claim 1, wherein the interior of said encapsulating housing is filled with an electrically insulating fluid.

11. The switchgear assembly according to claim 1, wherein said encapsulating housing is formed with a flange surface and wherein a phase conductor is supported on said flange surface in an electrically insulating fashion.

12. The switchgear assembly according to claim 11, which comprises a circuit breaker unit disposed in the interior of said encapsulating housing, said phase conductor forming a part of said circuit breaker unit.

13. The switchgear assembly according to claim 1, wherein said bulging wall is formed with multiple flange surfaces that are oriented substantially parallel to one another.

14. The switchgear assembly according to claim 13, wherein said multiple flange surfaces are formed to lie within a common plane.

15. A switchgear assembly, comprising:

an encapsulating housing;

a drive device and a kinematic chain connected to said drive device for transmitting a movement of said drive device into an interior of said encapsulating housing;

a spacer device mounting said drive device to said encapsulating housing, said spacer device forming a receiving space between said drive device and said encapsulating housing a plurality of bellows for fluid-tightly sealing said receiving space relative to said interior of said encapsulating housing; and wherein said kinematic chain reaches through said receiving space and into the interior of said encapsulated housing, and said interior of said encapsulating housing is fluid-tightly separated from said receiving space.

16. The switchgear assembly according to claim 15, wherein said encapsulating housing includes a bulging wall and said spacer device is mounted on said bulging wall.

17. The switchgear assembly according to claim 16, wherein said bulging wall is formed with a flange surface.

18. The switchgear assembly according to claim 16, wherein said bulging wall is formed with multiple flange surfaces that are oriented substantially parallel to one another.

19. The switchgear assembly according to claim 18, wherein said multiple flange surfaces are formed to lie within a common plane.

20. The switchgear assembly according to claim 15, wherein said bulging wall is formed with at least one flange surface.

21. The switchgear assembly according to claim 15, wherein said bulging wall is formed with multiple flange surfaces and said bellows are mounted on said flange surfaces.

22. The switchgear assembly according to claim 21, wherein said multiple flange surfaces are formed to lie within a common plane.

* * * * *